United States Patent [19]

Barnes

[11] 4,285,450

[45] Aug. 25, 1981

[54] WATCH BAND PIN CONNECTOR ASSEMBLY

[76] Inventor: Mary K. Barnes, P.O. Box 692, Sulphur, Okla. 73086

[21] Appl. No.: 124,131

[22] Filed: Feb. 25, 1980

[51] Int. Cl.[3] ..... A44C 5/18; A44C 5/14

[52] U.S. Cl. ..... 224/164; 24/265 B; 24/265 WS

[58] Field of Search ..... 224/164, 168, 175, 177, 224/180; 24/265 B, 265 WS

[56] References Cited

U.S. PATENT DOCUMENTS

| | | | |
|---|---|---|---|
| 1,818,637 | 8/1931 | Mathez | 24/265 WS |
| 1,999,707 | 4/1935 | Spiegel | 24/265 WS |
| 2,007,538 | 7/1935 | Kraemer | 24/265 B |
| 2,510,938 | 6/1950 | Boots | 24/265 B |
| 2,713,445 | 7/1955 | Speck | 24/265 WS |
| 3,612,365 | 10/1971 | Dintsman | 24/265 WS X |
| 3,712,173 | 1/1973 | Savioli et al. | 24/265 B X |
| 3,824,783 | 7/1974 | Nadeau | 24/265 B X |
| 3,939,534 | 2/1976 | Hayes | 24/265 B |
| 4,149,662 | 4/1979 | Ramaciere | 224/164 |

*Primary Examiner*—Steven M. Pollard

*Attorney, Agent, or Firm*—Dunlap, Codding & McCarthy

[57] ABSTRACT

An improved connector assembly for securing a watch band to the casing of a wrist watch is provided wherein the connector assembly is a telescoping spring-biased pin assembly comprising an elongated, tubular first member having an elongated slot provided in a side portion thereof; a first post member secured to one end of the tubular first member and positionable within a socket in the watch casing; a spring disposed within the tubular first member; an elongated second member positionable within the enlongated tubular first member and biased outwardly from the tubular first member by the spring, the elongated second member being adapted to be positioned within a second socket in the watch casing which is aligned with the first socket of the watch casing; and a pick engaging surface formed on the second member for engagement with a pick inserted through the elongated slot in the first tubular member so that the second member can be moved to a retracted position within the first tubular member by the pick for selectively removing or securing the watch band to the watch by the pin assembly. The watch band for use with the above-described connector assembly is provided with tubular links disposed on each hand of the watch band, the tubular links each having an elongated slot formed in one side portion thereof which is aligned with the elongated slot of the elongated tubular first member so that the pick can be positioned there through for engagement with the pick engaging surface formed on the elongated second member of the connector assembly.

16 Claims, 11 Drawing Figures

WATCH BAND PIN CONNECTOR ASSEMBLY

BACKGROUND OF THE INVENTION

1. Field of the Invention

This invention relates generally to the field of watch band connector assemblies, and more particularly, but not by way of limitation, to telescoping, spring-biased pin assemblies for securing a watch bad to a watch case. In one aspect, the present invention relates to an improved watch band wherein the terminal links of the watch band cooperate with the telescoping, spring-biased pin assembly to enable one to readily and efficiently secure a watch band to a watch case via the links of the watch band and the telescoping, spring-biased pin assembly.

2. Description of the Prior Art

For many years various means have been proposed for connecting a wrist band or bracelet to a watch case. The connector most commonly used to secure a watch band or bracelet to the watch case of a wristwatch is a telescoping, spring-biased pin. However, problems have been encountered when using the telescoping, spring-biased pin of the prior art for securing a watch band to the watch case because of the case closeness of fit between the watch band and the watch case. Further, because of the difficulties encountered in securing a watch band to a watch case using the telescoping, spring-biased pins of the prior art one must often have a watch band replaced by a jeweler or the like. Even such a skilled person as a jeweler often encountered difficulty in manipulating the prior art spring-biased pin into the proper position with respect to the watch case. Thus, a need has long been recognized for improvement in watch bands and connector assemblies which would allow one to quickly and efficiently change a watch band or bracelet on a wristwatch without the use of specialized instruments.

SUMMARY OF THE INVENTION

According to the present invention I have discovered an improved pin assembly for connecting a watch band or bracelet to the case of a wristwatch which overcomes the deficiencies of the prior art connectors so that a person can readily and efficiently replace the wrist band or bracelet of a wristwatch without the requirement of specialized instruments. Broadly, the improved pin assembly of the present invention, a telescoping, spring-biased pin assembly, comprises an elongated tubular first member having an elongated slot provided in a side portion thereof; a first post member extended from one of the tubular first member and adapted to be positioned within a socket in the case of the watch; a spring positioned within the tubular first member; an elongated second member positionable within the first member such that the spring biases the second member outwardly from the first member, one end of the second member being positionable within a second socket in the watch case; and a pick-engaging surface disposed on to the second member for engagement with a pick such that when the pick is inserted through the elongated slot in the first member and contacts the pick-engaging surface of the second member, the second member can be moved to a retracted position within the first member.

Further according to the present invention the terminal end links of the watch band, which are adapted to have the pin assemblies positioned there through, are each provided with an elongated slot formed in one portion thereof, the elongated slot of the link being alignable with the elongated slot of the tubular first member of the pin assembly so that the pick can be positioned there through for engagement with the pick engaging surface formed on the second member.

An object of the present invention is to provide an improved connector assembly for securing a watch band or bracelet to the case of a wristwatch.

Another object of the present invention is to provide an improved connector assembly for securing a watch band or bracelet to the case of a wristwatch wherein a person can readily change the watch band or bracelet without the use of specialized tools.

Another object of the present invention is to provide an improved connector assembly for connecting a watch band or bracelet to the case of a wristwatch so that the attachment of same can be carried out in an efficient, simplified manner.

Another object of the present invention is to provide an improved connector assembly for securing a wrist band or bracelet to the case of a wristwatch which is durable in construction, economical to manufacture, substantially maintenance free, and which does not suffer from the disadvantages of the prior art devices.

These and other objects, advantages and features of the present invention will become apparent to those skilled in the art from a reading of the following detailed description when read in conjunction with the accompanying drawings which illustrate the invention, and with the appended claims.

DESCRIPTION OF THE PREFERRED EMBODIMENTS

Figure 1:
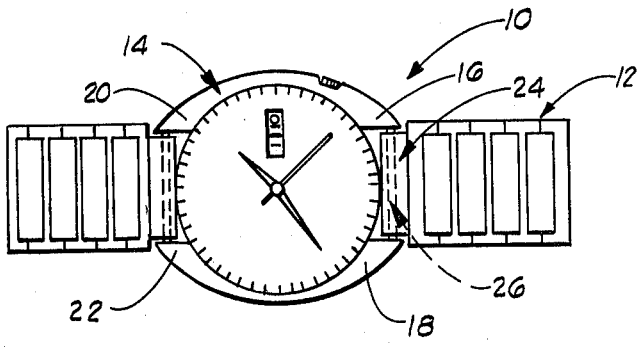
FIG. 1 is a front elevational view of a wristwatch having a wrist band connected thereto utilizing the improved pin assembly of the present invention, the terminal links of the wrist band having been modified in accordance with the present invention.
Figure 2:
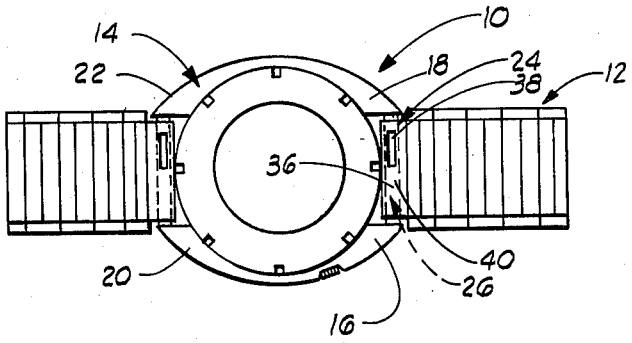
FIG. 2 is a rear elevational view of the wristwatch of FIG. 1 having a wrist band connected thereto utilizing the improved pin assembly of the present invention, the terminal links of the wrist band having been modified in accordance with the present invention.

Referring now to the drawings, and particularly to FIGS. 1 and 2, a wristwatch 10 is depicted having a watch band 12 connected thereto. The wristwatch 10 comprises a watch case 14 having a first pair of substantially parallel, spatially disposed lugs 16, 18 on one side thereof, and a second pair of substantially parallel, spatially disposed lugs 20, 22 on an opposed side thereof such that the first pair of lugs 16, 18 are substantially opposite the second pair of lugs 20, 22. Since the first pair of lugs 16, 18 and the second pair of lugs 20, 22 are substantially identical in structure and function, only the first pair of lugs 16, 18 will be discussed in detail.

The lugs 16, 18 are disposed a sufficient distance apart so that a terminal link 24 of the watch band 12 can be positioned therebetween for connection of the watch band 12 to the watch case 14 via a telescoping, spring-biased pin assembly 26. As more clearly shown in FIGS. 10 and 11, the connection of the watch band 12 to the watch case 14 via the terminal link 24 and the pin assembly 26 is accomplished by providing axially aligned sockets 28, 30 in opposed facing surfaces 32, 34 of the lugs 16, 18, the axially aligned sockets 28, 30 adapted to receive the pin assembly 26 as will be more fully described hereinafter.

Figure 3:
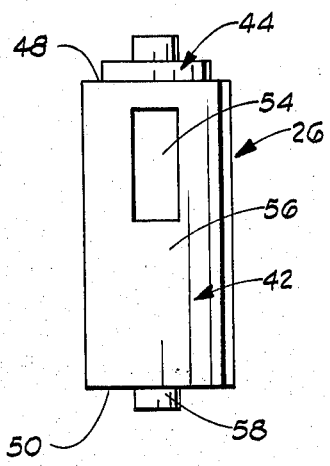
FIG. 3 is an enlarged front elevational view of the telescoping, spring-biased pin assembly of the present invention.
Figure 4:
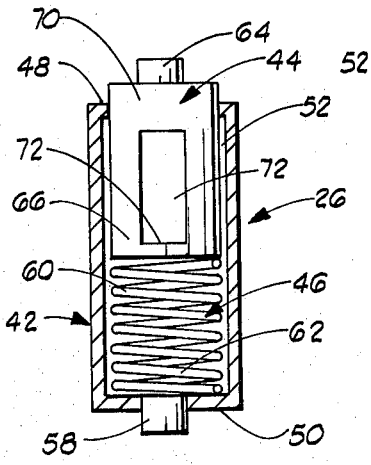
FIG. 4 is an enlarged, cross-sectional view of the telescoping, spring-biased pin assembly of FIG. 3.
Figure 5:
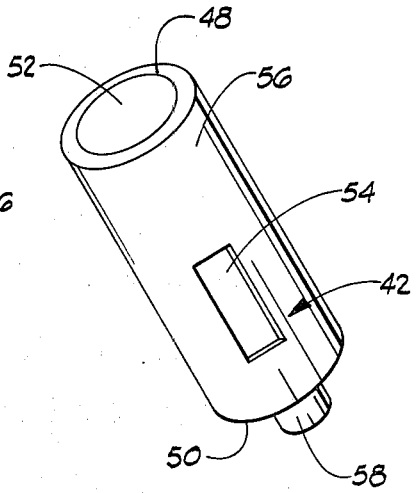
FIG. 5 is an enlarged, perspective view of the elongated, tubular first member of the telescoping, spring-biased pin assembly of FIG. 3.
Figure 10:
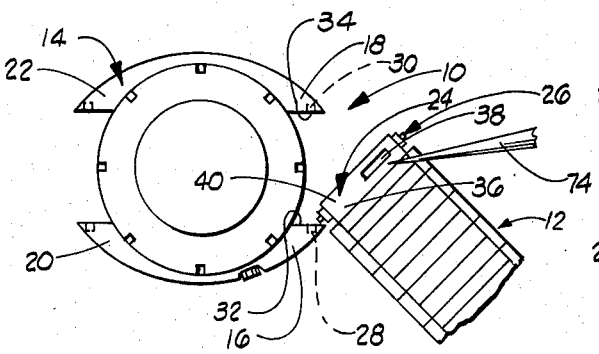
FIG. 10 is an enlarged, rear elevational view of a wristwatch depicting the modified terminal link of the wrist band and the improved telescoping, spring-biased pin assembly of the present invention positioned therein, the elongated seond member of the telescoping spring-biased pin assembly being depicted in an extended position.
Figure 11:
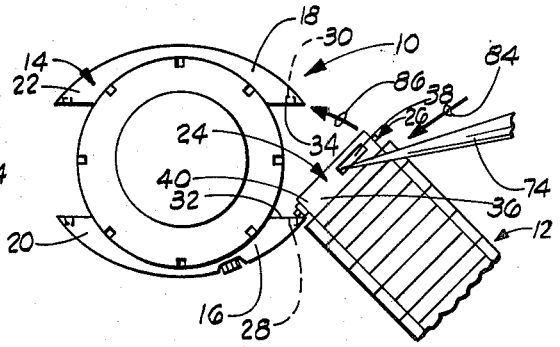
FIG. 11 is an enlarged, rear elevational view of a wristwatch depicting the modified terminal link of the wrist band and the improved telescoping, spring-biased pin assembly of the present invention positioned therein, the elongated second member being depicted in a partially retracted position within the elongated tubular first member.

Referring more specifically to FIGS. 2, 10 and 11, the terminal link 24 of the watch band 12 comprises a tubular member 36 having an elongated slot 38 formed in a side portion 40 thereof. Preferably, for reasons of appearance, the side portion 40 of the tubular member 36 is the rear side portion so that the elongated slot 38 formed in the side portion 40 will be positioned adjacent the back side of the watch case 14 when the terminal link 24 is positioned between the lugs 16, 18 of the watch case 14. The tubular member 36 is adapted to receive a telescoping, spring-biased pin assembly 26 therein such that the telescoping, spring-biased pin assembly 26 can engage the sockets 28, 30 disposed in the facing surfaces 32, 34 of the lugs 16, 18 for securing the terminal link 24 of the watch band 12 to the watch case 14 substantially as shown in FIGS. 2 and 3. The elongated slot 38 formed in the side portion 40 of the tubular member 36 of the terminal link 24 cooperates with the telescoping, spring-biased pin assembly 26 to enable one to readily and effectively secure or remove the watch band 12 from the watch case 14 as will be described in more detail hereinafter.

Referring now to FIGS. 3–6, the telescoping, spring-biased pin assembly 26 of the present invention is more clearly set forth. The telescoping, spring-biased pin assembly 26 comprises an elongated tubular first housing or member 42 (hereinafter referred to as first member 42), an elongated second member 44 (hereinafter referred to as second member 44) and a spring 46.

The first member 42 is provided with a first end 48 and an opposed second end 50. The first end 48 of the first member 42 opens into a hollow interior portion 52 of the first member 42 so that the second member 44 is positionable within the hollow interior portion 52 of the first member 42. The first member 42 is further provided with an elongated slot 54 in a side portion 56 thereof, the elongated slot 54 being alignable with the elongated slot 38 in the terminal link 24 of the watch band 12 when same are in an assembled position.

A first post member 58 is disposed on the opposed second end 50 of the first member 42 such that the post member 58 can be positioned within the socket 28 in the lug 16 of the watch case 14.

The spring 46, illustrated as a coil spring, is provided with a first end 60 and a second end 62. The spring 46 is positioned in the hollow interior portion 52 of the first member 42 such that the second end 62 of the spring 46 abuts the opposed second end 50 (e.g., the closed end portion) of the first member 42. The spring 46 can be disposed in the hollow interior portion 52 of the first member 42 in a freestanding position, or the second end 62 of the spring 46 can be secured to the opposed second end portion 50 of the first member 42 by any suitable means, such as welding, and the like.

The second member 44 is positionable within the hollow interior portion 52 of the first member 42 as hereinbefore stated. The second member 44 is provided with a first end 64 and an opposed second end 66. Thus, in an assembled position, the opposed second end 66 of the second member 44 engages the first end 60 of the spring 46, and the first end 64 of the second member 44 is biased outwardly a distance from the hollow interior portion 52 of the first member 42. Further, the first end 64 of the second member 44 is adapted to be positionable within the aligned socket 30 of the lug member 18 as depicted in FIGS. 10 and 11.

Figure 6:
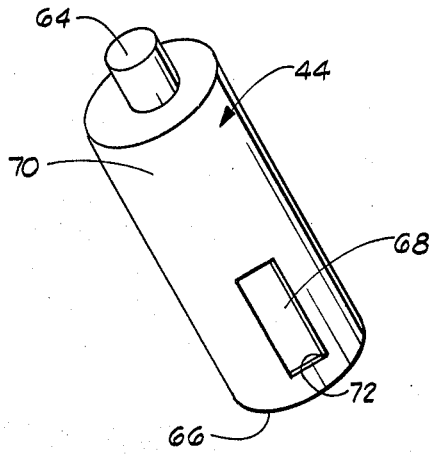
FIG. 6 is an enlarged, perspective view of the elongated second member of the telescoping, spring-biased pin assembly of FIG. 3.

As more clearly shown in FIG. 6, the second member 44 of the telescoping, spring-biased pin assembly 26 is provided with a recessed portion 68 formed on a side portion 70 thereof, the recessed portion 68 defining a lower pick-engaging surface 72 which is substantially normal to the longitudinal axis of the second member 44. Thus, when the second member 44 is positioned within the first member 42 of the pin assembly 26, the pick-engaging surface 72 of the second member 44 can be aligned with the elongated slot 54 of the first member 42. Thereafter, a pick 74 (see FIGS. 11 and 12) can be positioned through the aligned, elongated slots 38, 54 of the tubular member 36 of the terminal link 24 and the first member 42 of the pin assembly 26, respectively. The pick 74, upon engagement with the pick-engaging surface 72 of the second member 44 of the pin assembly 26, can move the second member 44 to a retracted position within the first member 42 (see FIG. 12) such that the first end portion 64 of the second member 44 is substantially adjacently disposed to the first end 48 of the first member 42. Thus, when the second member 44 is in the retracted position as described above, one can readily position the terminal link 24 of the watch band 12 and the pin assembly 26 between the lugs 16, 18 of the watch case 14. Once the terminal link 24 has been positioned therebetween, such that the first end 64 of the second member 44 of the pin assembly 26 is aligned with the socket 30 in the lug 18 of the watch case 14, (the first post member 58 of the pin assembly 26 having been previously positioned within the socket 28 of the lug 16), the pick 74 is disengaged from the pick-engaging surface 72 of the second member 44 of the pin assembly 26 and the spring 46 biases the second member 44 of the pin assembly 26 outwardly for engagement with the socket 30 of the lug 18 and secure the watch band 12 to the watch case 14.

Figure 7:
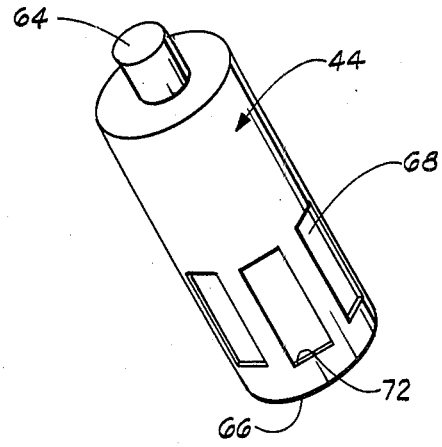
FIG. 7 is an enlarged, perspective view of a second embodiment of the elongated second member of the telescoping, spring-biased pin assembly of the present invention, the elongated second member having a plurality of pick-engaging surfaces formed thereon.

As is evident from the above, it may be necessary to rotatably move the second member 44 of the pin assembly 26 within the first member 42 so as to align the pick-engaging surface 72 of the second member 44 with the elongated slots 38, 54 of the tubular member 36 of the terminal link 24 and the first member 42 of the pin assembly 26, respectively. If one desires, one can substantially eliminate the necessity for the aligning of the pick-engaging surface 72 of the second member 44 with the elongated slots 38, 54 of the terminal link 24 and the first member 42, as described above, by providing the second member 44 of the pin assembly 26 with a plurality of the recessed portions 68, each recessed portion 68 having the pick-engaging surfaces 72 peripherally around the second member 44. Preferably the plurality of the recessed portions 68 are disposed near the opposed second end 66 of the second member 44 (substantially as shown in FIG. 7) so that at least a portion of the pick-engaging surface 72 of one of the recessed portions 68 is continually aligned with the elongated slots 38, 54 of the tubular member 36 of the terminal link 24 and the first member 42 of the pin assembly 26.

Figure 8:
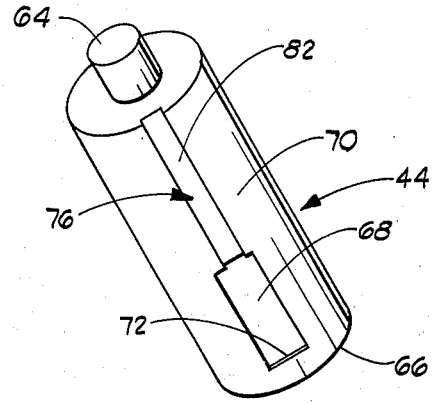
FIG. 8 is an enlarged, perspective view of a third embodiment of the elongated second member of the telescoping, spring-biased pin assembly of the present invention, the elongated second member having a pick-engaging surface and an elongated guide slot formed thereon.
Figure 9:
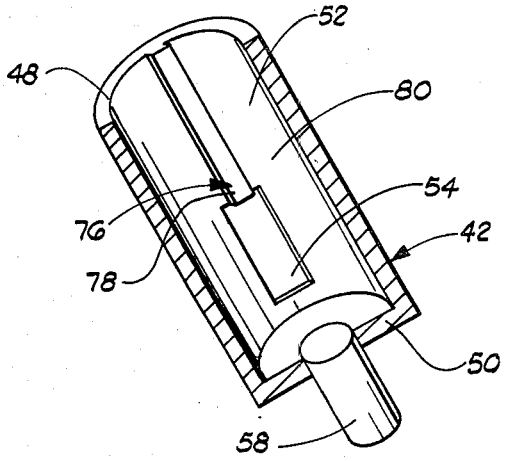
FIG. 9 is an enlarged, cross-sectional view of a second embodiment of the elongated tubular first member of the telescoping, spring-biased pin assembly of the present invention, the tubular first member having an elongated slot positioned therein and a guide rail disposed on the interior surface portion of the tubular first member so as to extend a distance into the hollow interior portion of said member.

Referring now to FIGS. 8 and 9, the telescoping, spring-biased pin assembly 26 further comprises a stabilizing assembly 76 to insure that the pick-engaging surface 72 (formed by the recessed portion 68 in the second member 44 of the pin assembly 26) is maintained in alignment with the elongated slots 38, 54 of the terminal link 24 of the watch band 12 and the first member 42 of the pin assembly 26, respectively, as hereinbefore described. The stabilizing assembly 76 comprises a track member 78 (disposed on an interior side portion 80 of the first member 42 of the pin assembly 26) and an elongated guide slot 82 (formed in the side portion 70 of the second member 44 of the pin assembly 26). The track member 78 extends a distance into the hollow interior portion 52 of the first member 42 from the interior side portion 80 of the first member 42 and the elongated guide slot 82 of the second member 44 is adapted to slideably receive the track member 78 of the first member 42 when same is positioned therein so that the second member 44 of the pin assembly 26 is maintained in a desired relationship with the first member 42 of the pin assembly 26 as the second member 44 is moved between the retracted position and an extended position. For ease of construction, the elongated guide slot 82 of the stabilizing assembly 76 extends substantially from the recessed portion 68 forming the pick-engaging surface 72 of the second member 44 (as hereinbefore described) towards the first end 64 of the second member 44 of the pin assembly 26 substantially as shown in FIG. 8.

In order to further illustrate the improved telescoping, spring-biased pin assembly 26, and its use in combination with the terminal link 24 of a watch band 12 to secure the watch band 12 to the watch case 14 of the wristwatch 10, the following modes of operation will be presented with reference to FIGS. 11 and 12. The telescoping, spring-biased pin assembly 26 is positioned within the tubular member 26 of the terminal link 24 of the watch band 12 and the first post member 58 (secured to the first member 42 of the pin assembly 26) is positioned within the socket 28 of the lug 16. Thereafter, the elongated slot 54 in the first member 42 of the pin assembly 26 is aligned with the elongated slot 38 in the tubular member 36 of the terminal link 24 of the watch band 12. The pick-engaging surface 72 of the second member 44 of the pin assembly 26 is then checked for alignment, if necessary, with the beforementioned elongated slots 38, 54. Once the pick-engaging surface 72 has been properly aligned with the elongated slots 38, 54, the pick 74 is positioned through the aligned elongated slots 38, 54 and engages the pick-engaging surface 72 of the second member 44 of the pin assembly 26. Thereafter, by applying pressure on the pick-engaging surface 72 via the pick 74 (in the direction indicated by the arrow 84) the second member 44 of the pin assembly 26 is retracted into the first member 42 of the pin assembly 26 so that the first end 64 of the second member 44 is substantially adjacently disposed the first end 48 of the first member 42 and the corresponding adjacent end portion of the terminal link 24. While maintaining pressure on the second member 44 of the pin assembly 26 via the pick 74 and the pick-engaging surface 72 of the second member 44 (in the direction indicated by the arrow 84), the watch band 12, (and thus the terminal link 24 and the pin assembly 26) are moved in the direction indicated by the arrow 86 until the first end 64 of the second member 44 of the pin assembly 26 is aligned with the socket 30 in the lug 18 of the watch case 14. Once the first end 64 of the second member 44 of the pin assembly 26 has been aligned with the socket 30 as described above, the pick 74 is removed from engagement with the pick engaging surface 72 of the second member 44 of the pin assembly 26 (and the pick 74 withdrawn from the aligned elongated slots 38, 54 of the tubular member 36 of the terminal link 24 and the first member 42 of the pin assembly 26, respectively) so that the spring 46 of the pin assembly 26 forces the second member 44 outwardly from the first member 42 and into engagement with the socket 30 of the lug 18.

To remove the watch band 12 from engagement with the watch case 14, the pick 74 is positioned through the aligned, elongated slots 38, 54 of the tubular member 36 of the terminal link 24 and the first member 42 of the pin assembly 26, respectively, so that the pick 74 engages the pick-engaging surface 72 of the second member 44 of the pin assembly 26. Thereafter, pressure is applied to the second member 44 of the pin assembly 26 in the direction indicated by the arrow 84 to retract the second member 44 into the first member 42 of the pin assembly 26 so that the first end 64 of the second member 44 is disengaged from the socket 30 in the lug 18. Thereafter, while maintaining the second member 44 of the pin assembly 26 in the retracted position the watch band 12 is pivoted in a direction opposite that indicated by the arrow 86 to a position substantially as shown in FIG. 12. Thereafter, the pick 74 can be removed from engagement with the pick-engaging surface 72 of the second member 44 of the pin assembly 26 and withdrawn from the aligned elongated slots 38, 54 of the terminal link 24 of the watch band 12 and the first member 42 of the pin assembly 26 as hereinbefore described.

It is clear that the present invention is well adapted to carry out the objects and attain the ends and advantages mentioned as well as those inherent therein. While a presently preferred embodiment of the present invention has been described for purposes of this disclosure, numerous changes may be made which will readily suggest themselves to those skilled in the art and which are encompassed within the spirit of the invention disclosed and defined in the appended claims.

What is claimed is:

1. An improved pin assembly for connecting a watch band to a watch, the pin assembly comprising:

an elongated, tubular first member having a first end and an opposed second end, the first end opening into a hollow interior portion of the first member, the first member having an elongated slot provided in a side portion thereof;

a first post member extending from the opposed second end of the first member, the first post member adapted to be positioned within a socket in the watch;

a spring having a first end and a second end, the spring being disposed in the hollow interior portion of the first member such that the second end of the spring abuts the opposed second end of the first member;

an elongated second member having a first end and an opposed second end, the second member positionable within the hollow interior portion of the first member such that the opposed second end of the second member engages the first end of the spring and the first end of the second member is biased outwardly from the hollow interior portion of the first member, the first end of the second member adapted to be positioned within a second aligned socket of the watch; and pick engaging means formed on the second member for engagement with a pick inserted through the elongated slot in the first member so that the second member can be moved to a retracted position within the first member by the pick for selectively removing or securing the watch band to the watch via the pin assembly.

2. The improved pin assembly of claim 1 wherein the pick engaging means comprises at least one pick-engaging surface formed as an integral part of the second member, the second member rotatably positioned in the tubular first pin member so that the pick-engaging surface is alignable with the elongated slot of the tubular first member and engageable with the pick such that the second member can be moved via the pick to the retracted position within the tubular first member wherein the opposed second end of the second member is substantially adjacently disposed to the opposed second end of the tubular first member.

3. The improved pin assembly of claim 1 wherein the pick engaging means comprises at least one recessed portion formed on a side portion of the second member, the recessed portion defining a lower pick-engaging surface substantially normal to the longitudinal axis of the second member, the lower pick-engaging surface of the recessed portion being alignable with the elongated slot in the tubular first member such that upon positioning the pick through the elongated slot of the tubular first member and engaging the pick with the lower pick-engaging surface of the recessed portion of the second member, the second member can be moved via the pick to a retracted position within the first member.

4. The improved pin assembly of claim 3 wherein a plurality of the recessed portions are disposed peripherally around the second pin member, the recessed portions being disposed such that at least a portion of the pick-engaging surface of one of the recessed portions is continually aligned with the elongated slot in the tubular first member.

5. The improved pin assembly of claim 1 wherein the pick-engaging surface of the second member is disposed in close proximity to the first end of the second member, and wherein the pin assembly further comprises stabilizing means operably disposed on the tubular first member and the second member for maintaining the pick engaging means of the second member in alignment with the elongated slot of the tubular first member.

6. The improved pin assembly of claim 5 wherein the stabilizing means comprises a track member and an elongated guide slot, the track member slideably positionable within the elongated guide slot, the track member disposed on an interior side portion of the tubular first member along the longitudinal axis of the tubular first member so as to extend a distance therefrom and into the hollow interior portion of the tubular first member, the elongated guide slot being formed in a side portion of the second member.

7. The improved pin assembly of claim 6 wherein the elongated guide slot extends along the longitudinal axis of the second member from the pick engaging means disposed thereon towards the first end of the second member.

8. The improved pin assembly of claim 7 wherein the pick engaging means comprises a recessed portion formed on a side portion of the second member, the recessed portion defining a lower pick-engaging surface substantially normal to a longitudinal axis of the second member, the lower surface of the recessed portion alignable with the elongated slot in the tubular first pin member such that upon positioning the pick through the elongated slot of the tubular first member and engaging the pick with the lower pick-engaging surface of the recessed portion of the second member, the second member can be moved via the pick to a retracted position within the tubular first member.

9. An improved watch band-pin connecting assembly for connecting a watch band to a watch case wherein the watch band is provided with a first and a second end, the watch case is provided with a first pair of substantially parallel, spatially disposed lug members extending from a first side portion of the watch case, and a second pair of substantially parallel, spatially disposed lug members extending from a second side portion of the watch case so as to be substantially opposite the first pair of lug members, the first pair of lug members having axially aligned sockets in facing surfaces thereof and adapted to receive therebetween the first end of the watch band, the second pair of lug members having axially aligned sockets in facing surfaces thereof and adapted to receive therebetween the second end of the watch band, the improved watch band-pin assembly comprising, in combination:

a tubular link disposed on each of the first and the second end of the watch band, the tubular link having an elongated slot formed in one side portion thereof;

a telescoping, spring-biased pin assembly positionable within each of the tubular links and engagable with the axially aligned sockets in the facing surfaces of the first and second pairs of lug members for securing the first and secnd ends of the watch band to the watch case, the telescoping, spring-biased pin assembly comprising:

a tubular housing having a closed first end, a substantially open second end, and a longitudinally disposed, elongated slot formed in a side portion thereof;

a first post member disposed on the closed first end of the tubular housing, the first post member positionable within the socket of one of the spatially disposed lug members of the watch case;

a spring disposed within the tubular housing such that the spring is supported therein by the closed first end;

an elongated member having a first end and an opposed second end, the elongated member positionable within the tubular housing such that the first end of the elongated member engages the spring, the spring biasing the elongated member so that the opposed second end of the elongated member extends a distance from the open second end of the tubular housing, the opposed second end of the elongated member positionable within the socket of the other of the spatially disposed lug members of the watch case; and pick engaging means disposed on the elongated member for engagement with a pick such that in an assembled position the pick engaging means of the elongated pin member is alignable with the elongated slot in the tubular link and the elongated slot in the tubular housing of the pin assembly so that upon positioning the pick through the elongated slots and engaging the pick engaging means of the elongated member with the pick the elongated member is movable to a retracted position wherein the opposed second end of the elongated member is disposed substantially adjacent the opposed second end of the tubular housing of the pin assembly and the tubular link of the watch band is movable between the spatially disposed lug members.

10. The improved pin assembly of claim 9 wherein the pick engaging means comprises at least one pick-engaging surface formed as an integral part of the elongated member, the elongated member rotatably positioned in the tubular housing so that the pick-engaging surface is alignable with the elongated slot in the tubular housing and engagable with the pick such that the elongated member can be moved via the pick to the restricted position within the tubular housing.

11. The improved pin assembly of claim 9 wherein the pick engaging means comprises at least one recessed portion formed on a side portion of the elongated member, the recessed portion defining a lower pick-engaging surface substantially normal to the longitudinal axis of the elongated member, the lower pick-engaging surface of the recessed portion being alignable with the elongated slot in the tubular housing such that upon positioning the pick through the elongated slot of the tubular housing and engaging the pick with the lower pick-engaging surface of the recessed portion of the elongated member, the elongated member can be moved via the pick to the retracted position within the tubular housing.

12. The improved pin assembly of claim 11 wherein a plurality of the recessed portions are disposed around the side portion of the elongated member, the recessed portions being disposed such that at least a portion of one of the pick-engaging surface of one of the recessed portions is continually aligned with the elongated slot in the tubular housing.

13. The improved pin assembly of claim 9 wherein the pick-engaging surface of the elongated member is disposed in close proximity to the first end of the elongated member, and wherein the pin assembly further comprises stabilizing means operably disposed on the tubular housing and the elongated member for maintaining the pick engaging means of the elongated member in alignment with the elongated slot in the tubular housing.

14. The improved pin assembly of claim 13 wherein the stabilizing means comprises a track member and an elongated guide slot, the track member slideably positionable within the elongated guide slot, the track member disposed on an interior side portion of the tubular housing along the longitudinal axis of the tubular housing so as to extend a distance therefrom and into the hollow interior portion of the tubular housing, being disposed the elongated guide slot being formed in a side portion of the elongated member.

15. The improved pin assembly of claim 14 wherein the elongated guide slot extends along the longitudinal axis of the elongated member from the pick engaging means disposed thereon towards the first end of the elongated member.

16. The improved pin assembly of claim 15 wherein the pick engaging means comprises a recessed portion formed on a side portion of the elongated member, the recessed portion defining a lower pick-engaging surface substantially normal to the longitudinal axis of the elongated member, the lower pick-engaging surface of the recessed portion alignable with the elongated slot in the tubular housing such that upon positioning the pick through the aligned elongated slots of the tubular link and the tubular housing, engaging the pick with the lower pick-engaging surface of the recessed portion of the elongated member, the elongated member can be moved via the pick to a retracted position within the tubular housing.

* * * * *